US005215802A

United States Patent [19]

Kaars Sijpesteijn

[11] Patent Number: 5,215,802

[45] Date of Patent: Jun. 1, 1993

[54] MAT

[75] Inventor: Johannes C. Kaars Sijpesteijn, Bloemendaal, Netherlands

[73] Assignee: Koninklijke Tufton B.V., Krommenie, Netherlands

[21] Appl. No.: 863,971

[22] Filed: Apr. 6, 1992

[30] Foreign Application Priority Data

Apr. 5, 1991 [EP] European Pat. Off. ..... 91200805.9

[51] Int. Cl.[5] ..... B32B 3/06

[52] U.S. Cl. ..... 428/100; 428/52; 428/54; 428/58; 15/215; 15/216; 15/217; 15/238; 15/239; 52/177; 52/180; 52/579; 52/580; 404/35; 404/40

[58] Field of Search ..... 428/100, 54, 52, 58; 52/177, 180, 579, 580; 15/215, 216, 217, 238, 239; 404/35, 40

[56] References Cited

U.S. PATENT DOCUMENTS

| | | | |
|---|---|---|---|
| Re. 32,061 | 1/1986 | Ellingson | 428/54 |
| 2,138,085 | 11/1938 | Birtles | 15/215 |
| 3,039,575 | 6/1962 | Graham | 52/578 |
| 3,247,637 | 4/1966 | Robertson | 52/588 |
| 3,332,192 | 7/1967 | Kessler | 52/538 |
| 3,460,860 | 8/1969 | Stevens, Jr. | 287/20.92 |
| 3,462,181 | 8/1969 | Lewis | 287/189.36 |
| 4,029,834 | 6/1977 | Bartlett | 428/62 |
| 4,351,324 | 9/1982 | Bronkhorst | 128/80 J |
| 4,568,587 | 2/1986 | Balzer | 428/52 |
| 4,654,245 | 3/1987 | Balzer et al. | 428/52 |
| 4,766,020 | 8/1988 | Ellingson, Jr. | 428/54 |
| 4,807,412 | 3/1989 | Frederiksen | 52/177 |
| 4,877,672 | 10/1989 | Shreiner | 428/156 |

FOREIGN PATENT DOCUMENTS

| | | | |
|---|---|---|---|
| 0125618 | 11/1984 | European Pat. Off. . | |
| 0365869 | 5/1990 | European Pat. Off. . | |
| 9003103.2 | 6/1990 | Fed. Rep. of Germany . | |
| 801540 | 8/1936 | France | 15/217 |
| 1110713 | 4/1968 | United Kingdom . | |

OTHER PUBLICATIONS

European Search Report for 91 20 0805.9.

*Primary Examiner*—Ellis P. Robinson
*Assistant Examiner*—Nasser Ahmad
*Attorney, Agent, or Firm*—Beveridge, DeGrandi, Weilacher & Young

[57] ABSTRACT

The invention relates to a mat comprising a plurality of elongated rails arranged parallel to one another and each having a receiving portion adapted to receive a tread member. The rails are coupled by way of first and second connecting elements, preferably consisting of T-shaped members and U-shaped members, by insertion in a direction perpendicular to the longitudinal axis of the rails.

13 Claims, 3 Drawing Sheets

A
B
1
2
3
4
4'
5
6
7
8
9
10
11
12
13
14
15
16
20
21

MAT

FIELD OF THE INVENTION

The present invention relates to a mat comprising a plurality of elongated rails arranged parallel to one another, each rail having a receiving portion arranged to receive a tread member, and a plurality of coupling means for coupling a rail to an adjacent rail. The present invention further relates to a rail and a coupling means for such a mat.

BACKGROUND DISCUSSION

Such mats are known, and they are widely used, especially as indoor or outdoor floor mats at the entrance of public or office buildings. Depending on the type of tread members to be inserted into the rails, the mats are suitable for removing coarse or fine dirt from shoes upon entering the building and/or for providing a scraping effect as well as drainage of water or melted snow. Each rail comprises a receiving portion having on both sides longitudinally upstanding edge portions with horizontal top flanges which retain and thus fix a tread member in the rail after this has been inserted into the receiving portion of the rail.

In many cases, when assembling a mat with the aid of the coupling means having the shape of longitudinally extending grooves and corresponding ribs, both being integrated with the rails, successive rails are joined by sliding them endwise. The tread members are to be inserted into the receiving portion along the rail towards the other end, which operation is usually carried out in an assembling apparatus.

European Patent Application 0125618 discloses a mat of the preamble of claim 1, including rails that are connected by separate gutter-shaped connectors which are snapped into the rails. Tread members are accomodated in tread-member-receiving rails which are provided with snap connection means for being connected to the rails by downward insertion into the rails. Therefore, the assemblage of the known mat requires a considerable number of actions to be performed, i.e. the connection of the tread members to the tread-member-receiving rails, the connection of the latter rails to the supporting rails, and the interconnection of the supporting rails.

SUMMARY OF THE INVENTION

It is an object of the invention to provide a mat which can be assembled with less effort.

According to the invention, a mat is proved which comprises a plurality of elongated rails arranged parallel to one another, each rail having a receiving portion adapted to receive a tread member, the mat further comprising a plurality of coupling means for coupling a rail to an adjacent rail, as well as tread-member-retaining means, said coupling means comprising at least a first and a second connecting element, wherein said first and said second connecting elements are connected by insertion in a direction at least comprising a component substantially perpendicular to the longitudinal axis of the rails, characterized in that said first connecting element comprises at least one tread-member-retaining portion extending transversely with respect to the rails and partly over a respective tread-member-receiving portion of a respective rail. Therefore, a tread member itself may be simply inserted sideways, i.e. in a direction perpendicular to the longitudinal axis of the rails, preferably in a downward direction, into a receiving portion, and—upon interconnection of the rails—it may be retained or clamped along a longitudinal edge by the transversely extending portion of the first connecting element. This first connecting element may be integrated with a rail or may be separated from the rail. Since the tread members can easily be manually inserted sideways as inlay members, the mat can be assembled on the spot, which provides e.g. an interior decorator with a great many options as to the size of the mat, the type, the colour etc. of the tread members and the overall pattern formed by the tread members. For the same reasons, cleaning and/or replacement of tread members or rails can be carried out very easily.

In order to obtain a firm and reliable connection between them, the first and second connecting element may extend along substantially the entire length of the respective rail, and they may be provided with snap means for creating a snap lock when being connected. The first connecting element may then be provided, at its insertion end, with a resilient portion of e.g. thermoplastic elastomer for resiliently abutting a corresponding abutting surface of the second connecting element when being connected, thus providing an even firmer connection.

According to a preferred embodiment of the mat according to the invention, the first connecting element has at least one member that is substantially T-shaped in cross-section, the lower end portion of said member forming an insertion end, and said first connecting element is integrated with a longitudinal side of a respective rail at an upper end portion of said T-shaped member. Adjacent rails can be interconnected by inserting the insertion end of the first connecting element into the second connecting element which may comprise at least one member which is substantially U-shaped in cross-section and which is disposed adjacent to one of the longitudinal sides of a rail. At least part of a leg of said U-shaped member which faces the rail may form an upstanding edge portion of the tread-member-receiving portion by which the U-shaped member both provides part of the edge of the receiving portion and a female type of connecting element.

Instead of being directly integrated with the rail, the connecting elements may be fixed to the rail through an intermediate member formed at a longitudinal side of the rail, for fixing the first or the second connecting element to the rail. At the same time, a horizontally extending recessed portion of the intermediate member may be provided with drain holes for draining water, which implies that the vertically extending part of the intermediate member is not weakened.

BRIEF DESCRIPTION OF THE DRAWINGS

The mat according to the present invention will be illustrated, by way of examples, on the basis of the accompanying drawings, in which.

DETAILED DESCRIPTION

Figure 1:
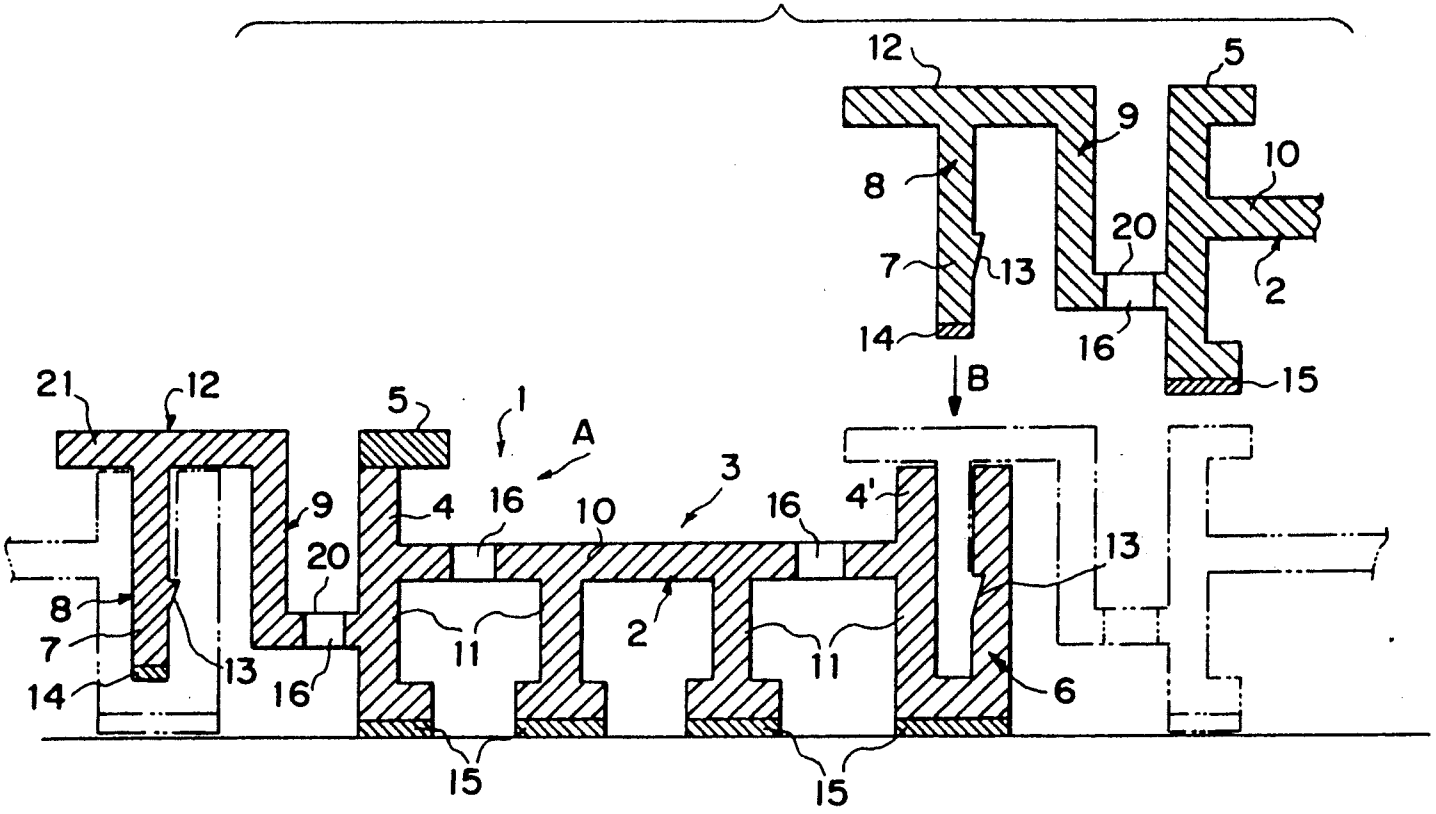
FIG. 1 shows a schematical cross-sectional view of part of a first embodiment of the mat according to the present invention.

Similar parts in the figures are indicated by the same reference numerals.

In FIG. 1, a part of a mat 1 having parallel, elongated rails 2 is shown in cross-section. Each rail 2 comprises a receiving portion 3 adapted to receive a respective tread member (not shown). The receiving portion 3 is defined by upstanding edges 4, 4' of which one has a flange 5 integrally formed with the respective edge 4. The other edge 4' is part of a U-shaped member 6 extending along the entire length of the rail 2 and forming a female-type connecting element which mates with an insertion end portion 7 of a male-type connecting element consisting of a T-shaped member 8 which is an integral part of the adjacent rail and fixed thereto via an intermediate member 9 at the upper end portion of the T-shaped member 8.

The receiving portion 3 has a bottom portion 10 supported by supporting ribs 11. The upstanding edges 4, 4', the bottom portion 10 and the supporting ribs 11 of the rail may be of any suitable, relatively rigid material, such as rigid plastic, elastomer or aluminium, etc. The flanges 5 and the lower ends 15 of the ribs may be of a resilient material, such as thermoplastic elastomer, to give the mat anti-slip properties and to adapt the mat to possible unevennesses of the underlying floor. The flange 5 and the lower ends 15 may be formed by co-extrusion with the other parts of the rail in case of a plastic or elastomer rail 2.

The tread members may be of any kind of material and may have any type of profile, depending on the desired properties of the mat.

The assembly of the mat will now be described. First a tread member is inserted sideways, i.e. perpendicular to the main or longitudinal extension of the rail, into the receiving portion 3 of the rail 2, as illustrated by arrow A in FIG. 1. Subsequently, the adjacent rail is connected to the former rail 2 by inserting connecting element 8 into connecting element 6 in a direction indicated by arrow B which is perpendicular to the longitudinal axis of the rail, and, in this case, perpendicular to the mat to be assembled. As the left-most part 21 of the upper portion 12 of the T-shaped member 8 extends over part of the tread-member-receiving portion 3, the previously inserted tread member is retained under any circumstances. A secure connection is provided by means of protrusions 13 of the U-shaped member 6 and T-shaped member 8, which protrusions 13 together create a snap-lock connection. A resilient portion 14 at the end of the T-shaped member 8 resiliently abuts the bottom surface of the U-shaped member 6, thus further improving a firm connection of the rails and at the same time of the overall resilience of the mat. In this way a mat 1 having any desired dimensions can be built.

In FIG. 1, the intermediate member 9 has an L-shaped cross-section. The horizontal bottom portion 20 of the intermediate member 9 and the bottom portion 10 of the tread member receiving portion 3 are provided with holes 16 for drainage of water and/or dirt.

Figure 2:
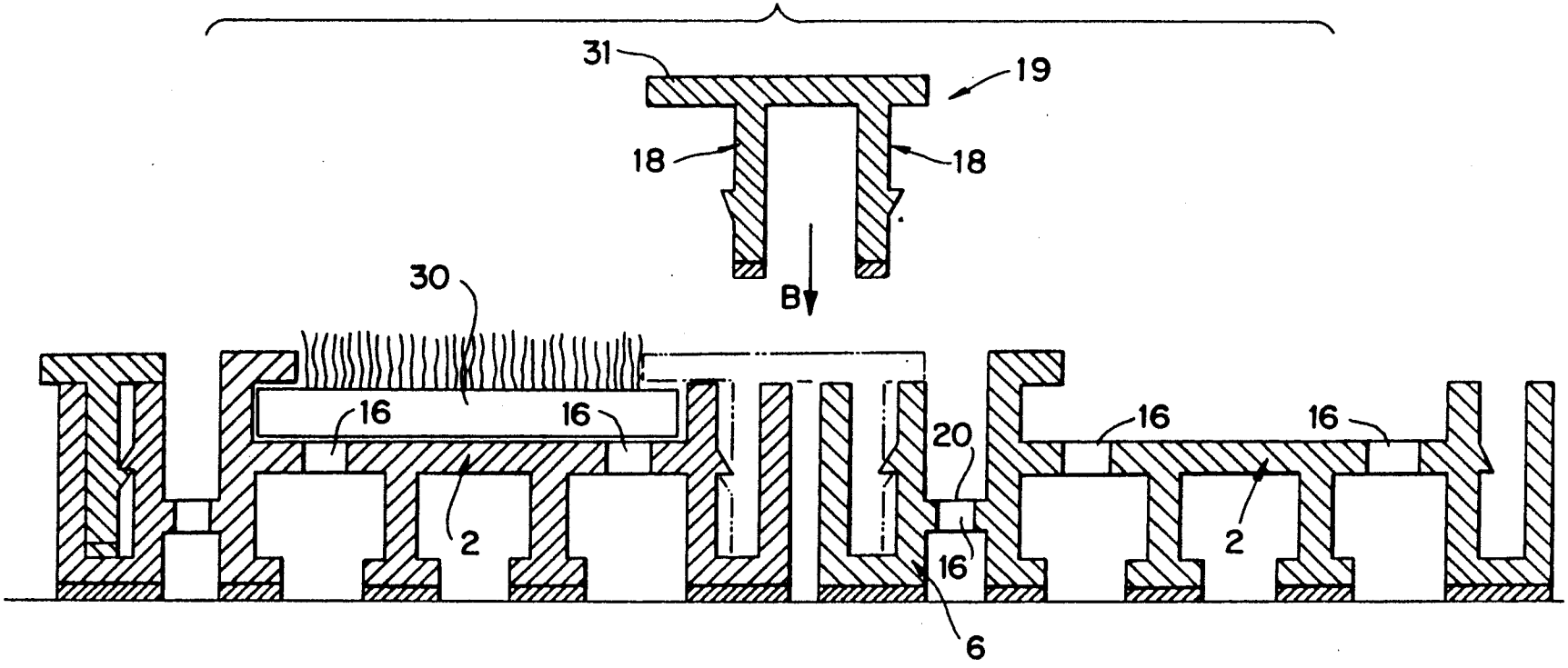
FIG. 2 shows a schematical cross-sectional view of part of a third embodiment of the mat according to the present invention.

FIG. 2 illustrates a second embodiment of the present invention, wherein the first connecting element 19 is separate from the rails 2 and consists of two integrated T-shaped members 18. After the assembly has been completed, the horizontally leftwards (as seen in the drawing) projecting portion 31 of the left T-shaped member 18 of connecting element 19 constitutes a retainer for tread member 30. The left-side U-shaped member 6 of rail 2 is distinct from the edge portion 4, through the intermediary of a horizontally extending portion 20 forming the intermediate member and having drainage holes 16.

Figure 3:
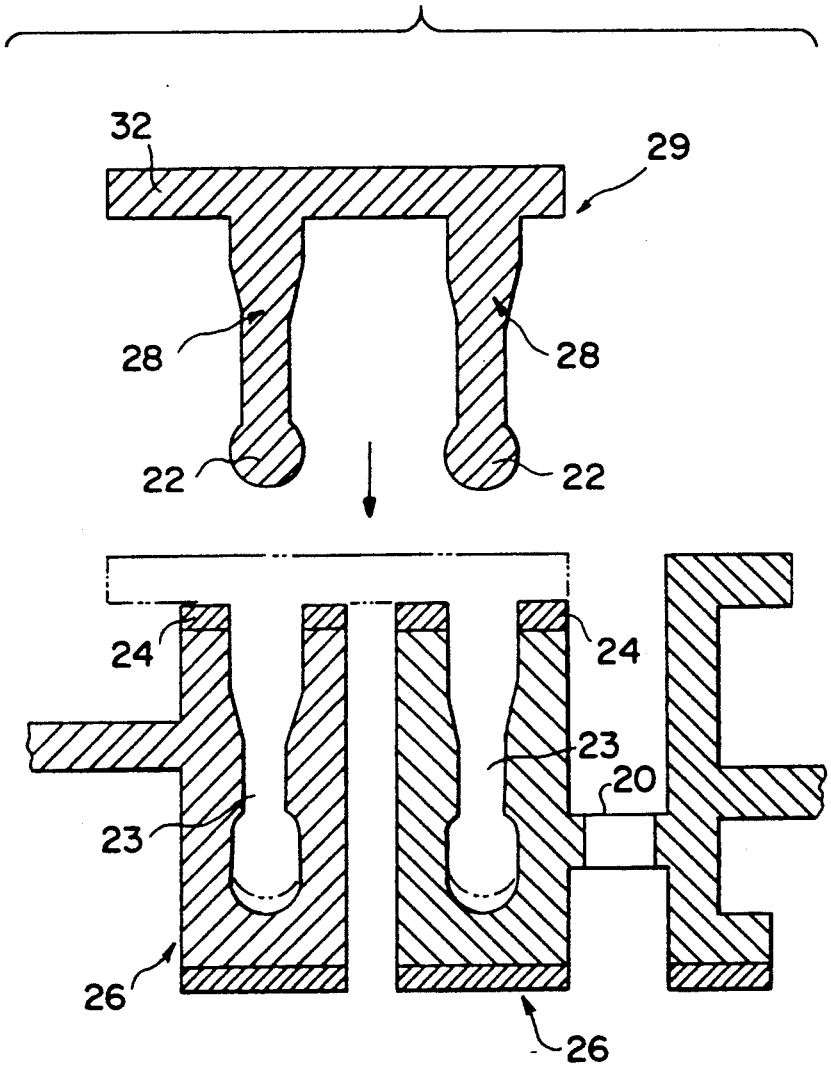
FIG. 3 shows a schematical cross-sectional view of part of a third embodiment of the mat according to the present invention.

FIG. 3 illustrates a part of a third embodiment of the mat according to the invention, wherein a snap-lock connection is formed by circular-shaped tip ends 22 of the T-shaped members 28, which cooperate with narrowings 23 at the inside of the U-shaped members 26. In this case, resilient portions 24 are provided on top of the U-shaped members 26. The circular-shaped ends 22 facilitate the disassembling of the mat. Horizontally leftwards projecting portion 32 has the same function as portion 31 of the first connecting element 19 of FIG. 2.

To those skilled in the art it will be clear that many changes and modifications can be made to the illustrated embodiments without deviating from the concept of the invention as claimed. For instance, the intermediate members 9, 20 may be omitted, in which case, as in FIG. 2, the first connecting element may show two opposite tread-member-retaining portions 21. Furthermore, the first connecting elements may be of the female type and the second connecting elements may be of the male type. As for the first connecting elements shown in FIGS. 2 and 3, the T-shaped member on the right side, i.e. the T-shaped member which is not provided with the tread-member-retaining portion, may be partly or completely made of a flexible material in order to facilitate the rolling-up of the mat, i.e. for cleaning purposes. The direction of insertion may be other than perpendicular to the rail, as long as lateral coupling of the rails is permitted. It will be clear that the outermost rails of the mat may have a different shape or that they may be connected to any additional peripheral elements of the mat.

I claim:

1. Mat comprising a plurality of elongated rails arranged parallel to one another, each rail (2) having a receiving portion (3) adapted to receive a tread member, the mat further comprising a plurality of coupling means for lengthwise coupling a rail to an adjacent rail, as well as tread-member-retaining means, said coupling means comprising at least a first and a second connecting element, wherein said first and said second connecting elements are connected by insertion in a direction at least comprising a component perpendicular to the longitudinal axis of the rails (2), characterized in that said first connecting element comprises at least one tread-member-retaining portion (21) extending transversely with respect to the rails (2) and partly over a respective tread-member-receiving portion (3) of a respective rail.

2. Mat according to claim 1, wherein said first and second connecting elements are provided with snap means (13, 14; 22, 23, 24) so as to create a snap lock when they are connected and wherein said first connecting element is provided at its insertion end with a resilient portion (14), for resiliently abutting a corresponding abutting surface of the second connecting element when being connected.

3. Mat according to claim 1, wherein said first connecting element has at least one member (8, 18, 28) that is T-shaped in cross-section, the lower end portion (7) of said member forming an insertion end.

4. Mat according to claim 3, wherein said first connecting element is integrated with a longitudinal side of a respective rail at an upper end portion (12) of said T-shaped member (8).

5. Mat according to claim 1, wherein the second connecting element comprises at least one member (6, 26) which is U-shaped in cross-section and which is disposed at one of the longitudinal sides of a rail.

6. Mat according to claim 5, wherein at least part of a leg of said U-shaped member (6, 26) which faces the rail forms an upstanding edge portion (4') of the tread-member-receiving portion (3).

7. Mat according to claim 1, wherein an intermediate member (9, 20) is formed, at a longitudinal side of the rail (2), for fixing the first or second connecting element to the rail.

8. Mat according to claim 7, wherein said intermediate member comprises a horizontally extending, recessed portion (20) which is provided with a plurality of drain holes (16).

9. Mat according to claim 1, wherein said first connecting element is separate from said rail (FIG. 3).

10. Mat according to claim 9, wherein said first connecting element is comprised of two integrated T-shaped members (18; 28) and said second element is comprised of a first U-shaped member integral with one longitudinal side of a rail and adapted to receive a first of said integrated T-shaped members and a second U-shaped member integral with the opposite longitudinal side of a corresponding, adjacent rail of the mat and adapted to receive a second of said integrated T-shaped members when said first integrated T-shaped member is received within said first U-shaped member.

11. Mat according to claim 10, wherein said T-shaped members (28) have circular tip ends (22) and said U-shaped members (26) have narrowings (23) at their inside cooperating with said tip ends (22) for realizing a snap-lock connection.

12. Mat according to claim 1, wherein the first and second connecting elements extend along the entire length of the respective rail.

13. A mat, comprising:

a plurality of longitudinally elongated rails arranged parallel to one another, each rail having a receiving portion adapted to receive a tread member, each of said rails further including a bottom portion adapted to support the tread member and a first and a second upstanding edge extending transversely with respect to the bottom portion, and said first upstanding edge being spaced from said second upstanding edge such that said bottom portion and first and second upstanding edges define said receiving portion;

coupling means for coupling a rail to an adjacent rail, said coupling means comprising a first and a second connecting element, wherein said first and said second connecting elements are connected by insertion in a direction at least comprising a component perpendicular to the longitudinal axis of the rails, and said first connecting element comprising a tread-member-retaining portion, and, when said first connecting element is connected to said second connecting element, said tread-member-retaining portion extends transversely over said second upstanding edge and partly over said receiving portion at a position above said bottom portion such that said tread-member-retaining portion and said bottom portion extend above and below a tread member when the tread member is positioned in said receiving portion such that the tread member is retained in said receiving portion.

* * * * *